United States Patent [19]

Wolford et al.

[11] 4,214,133

[45] Jul. 22, 1980

[54] ROTARY SHAFT POSITION SWITCH

[76] Inventors: Byron F. Wolford, Rte. 6, Fergus Falls, Minn. 56537; John F. Rose, Rte. 1, Underwood, Minn. 56586

[21] Appl. No.: 863,219

[22] Filed: Dec. 22, 1977

Related U.S. Application Data

[63] Continuation-in-part of Ser. No. 758,577, Jan. 12, 1977, abandoned.

[51] Int. Cl.[2] ..... H01H 3/32; H01H 19/60

[52] U.S. Cl. ..... 200/31 R; 200/302

[58] Field of Search ..... 200/19 R, 19 M, 38 B, 200/38 BA, 38 C, 38 CA, 30 R, 30 A, 31 R, 47, 39 R, 153 L, 153 LA, 153 LB, 293, 302, 81.9 M, 81.9 R; 310/90, 103, 104; 308/10

[56] References Cited

U.S. PATENT DOCUMENTS

| | | | |
|---|---|---|---|
| 780,770 | 1/1905 | Wood | 308/10 |
| 1,708,276 | 4/1929 | Marks | 137/554 |
| 1,767,617 | 6/1930 | Payne | 137/554 X |
| 1,989,522 | 1/1935 | McWhirter | 200/38 BA |
| 2,241,983 | 5/1941 | Connolly | 310/104 |
| 2,564,676 | 8/1951 | Crouse | 310/104 X |
| 2,651,550 | 8/1953 | Sharp | 308/10 |
| 2,725,439 | 11/1955 | Newboult | 310/103 |
| 2,915,606 | 12/1959 | Knauth | 200/19 M X |
| 2,966,330 | 12/1960 | Binford | 251/65 |
| 3,128,909 | 4/1964 | Shield et al. | 200/38 CA X |
| 3,224,295 | 12/1965 | Ardern | 200/38 CA X |
| 3,315,523 | 4/1967 | Conkling | 310/104 |
| 3,538,948 | 11/1970 | Nelson et al. | 137/554 |
| 3,743,872 | 7/1973 | Dochterman | 310/90 |
| 3,747,892 | 7/1973 | Gigantino et al. | 251/65 |
| 3,791,620 | 2/1974 | Scott | 251/65 |
| 3,825,781 | 7/1974 | Woods | 200/38 R X |

FOREIGN PATENT DOCUMENTS

| | | |
|---|---|---|
| 1040571 | 9/1966 | United Kingdom . |
| 1191870 | 5/1970 | United Kingdom . |
| 1205145 | 9/1970 | United Kingdom . |
| 1291579 | 10/1972 | United Kingdom . |
| 1324027 | 7/1973 | United Kingdom . |

*Primary Examiner*—J. R. Scott

*Attorney, Agent, or Firm*—Merchant, Gould, Smith, Edell, Welter & Schmidt

[57] ABSTRACT

A rotary shaft position indicator and control in which a switch is housed within an enclosure sealed against dust, moisture, corrosive or explosive foreign materials and is magnetically actuated in response to rotary shaft position. In one embodiment a plurality of microswitches are disposed within a sealed switch cavity and cams are mounted on a rotatable spindle, each cam positioned to actuate a microswitch. A first annular magnet is secured to the spindle. Disposed proximate the first annular magnet and separated therefrom by a non-magnetic wall is a second annular magnet secured to the rotary shaft. The annular magnets are magnetically coupled through the non-magnetic wall such that rotation of the shaft causes the spindle to rotate, thereby actuating selected microswitches. In an alternative embodiment the microswitches are actuated magnetically by bar magnets secured to the rotary shaft and separated from the microswitches by a non-magnetic wall of the sealed housing.

12 Claims, 12 Drawing Figures

ROTARY SHAFT POSITION SWITCH

CROSS REFERENCE TO RELATED APPLICATIONS

This application is a continuation-in-part of U.S. patent application Ser. No. 758,577, filed Jan. 12, 1977, now abandoned.

BACKGROUND OF THE INVENTION

The present invention relates broadly to a device for indicating the rotational position of a rotary shaft, and more particularly, to a rotary shaft position indicator and control for use in harsh environmental conditions.

The present invention is particularly applicable to fluid and other flow systems in which it is desirable to monitor the condition of rotary valves (i.e. open or closed) and/or to control the opening or closing of successive valves in the flow line as a function of the open or closed state of the preceeding valves. Typically, in the prior art, electrical switches that are mechanically actuated in response to the operative state of the rotary valve have been utilized. These mechanically actuated switches are frequently subjected to severe environmental conditions to include dust, moisture, or other corrosive or explosive foreign matter. Such adverse environmental conditions have a deleterious effect on the electrical switches, and over a period of time may lead to switch malfunctions causing erroneous indicator and control signals. If, for example, a switch fails to generate and "open" or "closed" signal to a successive valve in a fluid flow system, it can be readily appreciated that serious consequences to the system operation may develop.

The present invention solves the problems associated with the prior art systems in that it provides a rotary shaft position indicator and control in which an electrical switch is enclosed within a housing that is sealed against the introduction of the above-mentioned deleterious matter. The switches are actuated utilizing a magnetic coupling through a non-magnetic wall of the housing. Thus, rotary shaft position indicator and control signals are generated utilizing switches which remain unaffected by the harsh environmental conditions that may exist in particular system applications.

SUMMARY OF THE INVENTION

The present invention is a rotary shaft position indicator and control which includes a housing having a switch cavity and means for sealing the housing to isolate the switch cavity from the exterior surroundings of the housing. Switch means are disposed within the switch cavity and a magnetic means is coupled to the rotary shaft to actuate the switch means as a function of rotary shaft position. The magnetic means transmits the position of the rotary shaft into switch actuation through one wall of the switch housing.

In one embodiment, a plurality of microswitches having pivotally mounted spring-biased switch actuating arms are disposed within the sealed switch cavity. A plurality of cams, each cam associated with a separate switch, are secured to a rotatable spindle mounted within the switch cavity. Attached to the rotatable spindle is an annular magnet positioned proximate a non-magnetic wall of the device housing. A second annular magnet is disposed proximate the non-magnetic wall exterior of the switch cavity and is secured to the rotary shaft. The annular magnets are magnetically coupled through the non-magnetic housing wall such that upon rotation of the rotary shaft the rotatable spindle also rotates in harmony. The cams are provided with cam surfaces which contact the switch actuating arms at selected rotational positions of the rotary shaft. The cams are adjustably mounted to the rotatable spindle to vary the rotational position of the switch actuation of selected switches or to delay or advance the actuation of the switches as the rotary shaft changes its rotational position. A resilient fastener, typically a spring clip, is provided for attachment to the rotary shaft to dampen any shocks inherent in the rapid change of the rotary shaft from one position to another.

In an alternative embodiment, the indicator and control switches are disposed within a sealed cavity and have pivotally mounted spring-biased switch actuating arms to which are secured bar-type magnets. The bar-type magnets are disposed generally proximate one wall of the sealed cavity. The rotary shaft is mechanically secured to a rotatable spindle mounted exteriorly with respect to the sealed cavity. Disposed along and secured to the rotatable spindle is a plurality of bar magnets which when in proximity to the non-magnetic wall of the sealed cavity magnetically repel the bar magnets associated with the switches. The bar magnets are adjustably mounted to the rotatable spindle to vary the rotational position of the shaft at which selected switches will be actuated, or to advance or delay switch actuation as the rotary shaft changes its orientation.

Thus, either embodiment of the present invention provides a rotary shaft position indicator and control in which the electrical switches which generate the indication and control signals are sealed within a cavity and protected from potentially harsh environmental conditions. The switches are actuated through a magnetic coupling. These and other advantages of our invention will become apparent with reference to the accompanying drawings, specification and claims.

DETAILED DESCRIPTION OF THE PREFERRED EMBODIMENT

Figure 1:
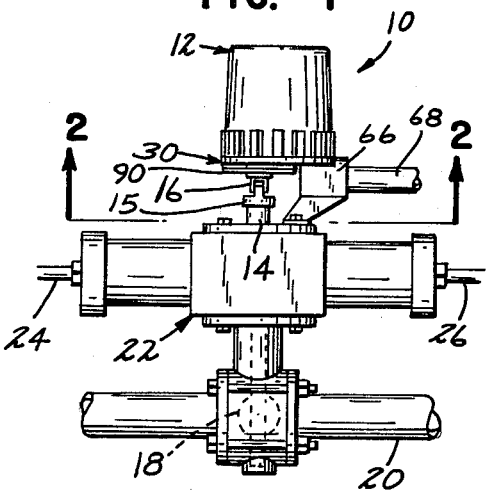
FIG. 1 is a side elevational view of the rotary shaft position indicator and control of the present invention operatively mounted to sense the position of a valve mechanism.
Figure 2:
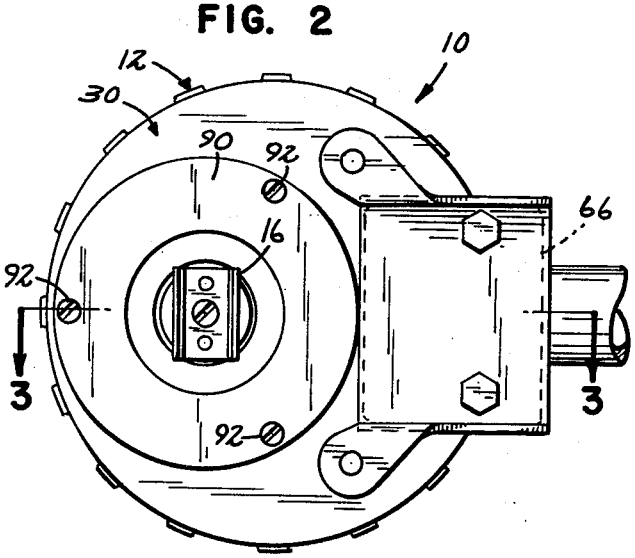
FIG. 2 is an enlarged end elevational view of the position indicator and control seen generally from the line 2—2 of FIG. 1.

Referring to the drawing, wherein like numerals represent like parts throughout the several views, one embodiment of the present invention is illustrated in FIG. 1 operatively connected to a pneumatically actuated rotary valve. More particularly, the rotary shaft position indicator and control is indicated generally at 10 and includes an essentially cylindrical first housing member 12. Rotary shaft position indicator and control 10 is coupled to a rotary shaft 14 by means of a spring clip 16 which will be described in greater detail. Secured to rotary shaft 14 is a disc or butterfly-type valve member 18 which controls fluid flow through conduit 20. The positioning of valve member 18 is accomplished by a conventional pneumatic actuating device 22. The introduction or exhaust of air through lines 24 and 26 into pneumatic actuating device 22 functions to rotate shaft 14 and thereby position valve member 18.

Rotary position indicator and control 10 will now be described more particularly with reference to FIGS. 2–5. Cylindrical housing member 12 is threaded internally at 28. A second housing member 30 is provided with external threads at 32 which mate with the internal threads at 28. Housing members 12 and 30 define a switch cavity 34. An O-ring seal 36 is provided proximate the threaded connection between housing members 12 and 30. O-ring 36 is compressed when housing member 12 is screwed onto housing member 30. Cavity 34 is thus effectively sealed from the environment surrounding rotary position indicator and control 10. Dust, moisture, or other corrosive or explosive foreign materials are prevented from entering cavity 34 by the seal between housing members 12 and 30. The seal between housing members 12 and 30 may also be achieved through mating surfaces on the housing members that are secured together by threaded fasteners.

Disposed within cavity 34 are a plurality of microswitches 38. Microswitches 38 are mounted vertically on screws 48 between an upper support plate 42 and an annular portion 44 of housing member 30. A plurality of spacer members 46 made of an insulating material position microswitches 38 along screws 48. The microswitches are illustrated more particularly in FIG. 4. Each microswitch has a switch actuating arm 50 which is pivoted at 52 and biased by spring 54 outward from a switch housing 56. Switch housing 56 has a projection 58 which acts as a stop to limit the rotation of actuating arm 50 about a pivot 52 under the influence of biasing spring 54. Switch make-or-break member 55 is positioned to be depressed or released by switch actuating arm 50. Microswitches 38 may be of any conventional type which provide snap-action in changing from one switch state to another. The switches shown in the drawing have a plurality of contacts 59, 60 and 62 which correspond to common, normally open, and normally closed states, respectively. Electrical conductors (not shown) are connected to contacts 59, 60 and 62 and lead from cavity 34 through a channel 64 formed in a projecting portion 66 of housing member 30. An electrical conduit 68 is threadably received within an aperture 70 in projecting portion 66. The threaded connection of conduit 68 to portion 66 is also sealed or potted to insure that cavity 34 is isolated from the environment.

Figure 3:
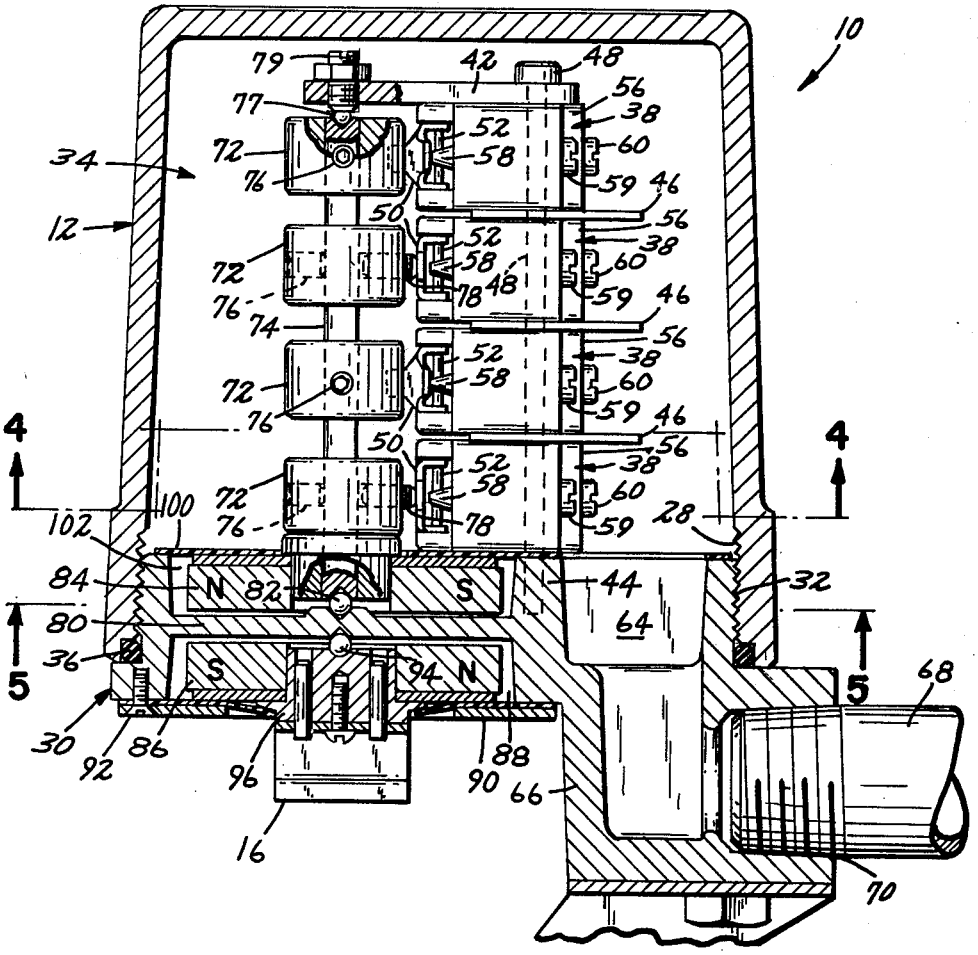
FIG. 3 is an enlarged axial sectional view as seen from the line 3—3 of FIG. 2.
Figure 4:
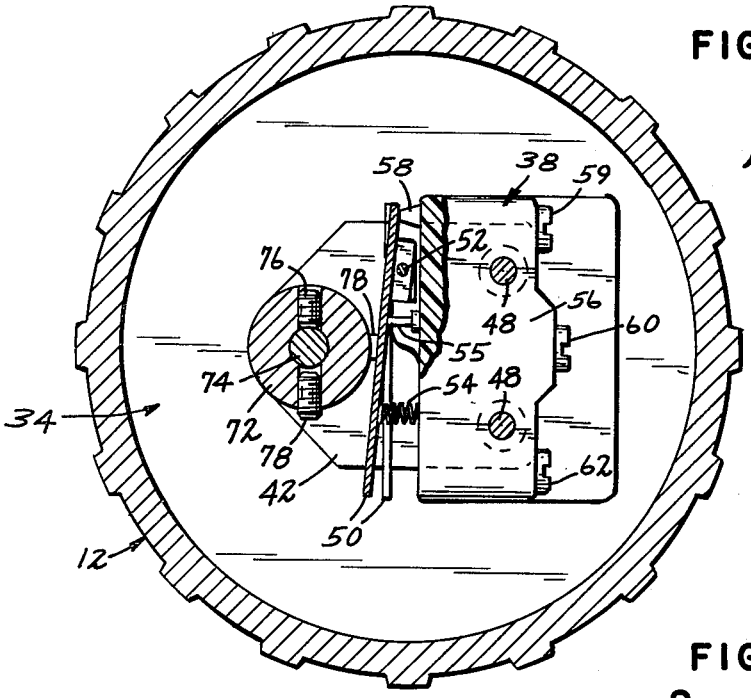
FIG. 4 is a transverse sectional view as seen from the line 4—4 of FIG. 3.
Figure 5:
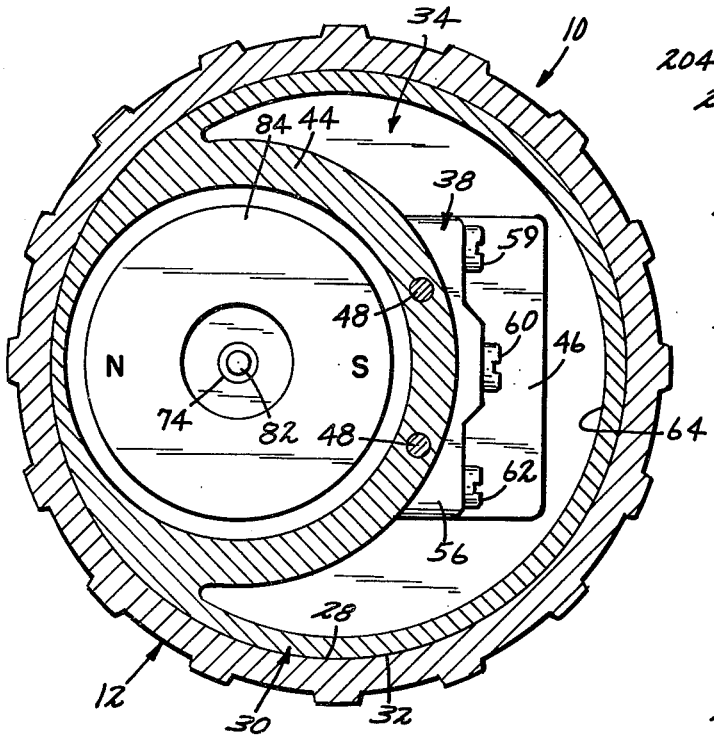
FIG. 5 is a transverse sectional view as seen from the line 5—5 of FIG. 3.

Switch actuating arms 50 are themselves actuated by a plurality of cams 72 disposed along and secured to a rotatable spindle 74. Cams 72 are secured to spindle 74 by set screws 76. Extending beyond the outer surface of cams 72 are set screws 78 which contact switch actuating arms 50 to depress the switch actuating arms against the bias of spring 54. Cams 72 are positioned about spindle 74 such that selective ones of the plurality of microswitches 38 are actuated at various rotational positions of spindle 74. As will be hereafter described, the rotational position of spindle 74 is directly related to the rotational position of shaft 14. Spindle 74 is rotatably mounted to support plate 42 through a ball bearing 76 received in a recess in spindle 74 and in contact with a retaining member 78 threadably engaging an aperture in support plate 42. Spindle 74 is in contact with a non-magnetic wall 80 of housing member 30 through a second ball bearing 82 captured between a recess in spindle 74 and a recess in non-magnetic wall 80. Secured to the lower end of spindle 74 is an annular magnet 84 having single or multiple north and south poles as indicated in FIG. 3. Disposed opposite wall 80 is a second annular magnet 86 also having similar but opposite north and south poles as indicated. Magnet 86 is held within an outwardly facing chamber 88 defined in housing member 30 by an annular plate 29 secured by screws 92 to housing member 30. A ball bearing 94 is captured between annular magnet 86 and housing wall 80 to permit rotation of annular magnet 86 in response to the angular rotation of shaft 14. Annular magnet 86 is integral with a magnet support member 96 to which is secured spring clip 16. As shown in FIG. 1, a coupling member 15 attached to shaft 14 is received within spring clip 16. Spring clip 16 provides a somewhat resilient connection between shaft 14 and annular magnet support 96 to dampen any shocks that might be transmitted due to the rapid changes of rotary valve position. It is to be understood that spring clip 16 is merely one method of transmitting the rotational motion of shaft 14 to magnet 86 contemplated within the spirit and scope of the present invention. For example, magnet 86 may have a shaft to which is secured a lever that is actuated by shaft 14. The rotary shaft position indicator could then serve as a limit switch. An annular layer of insulating material, for example plastic, is sandwiched between retaining plate 90 and housing member 30 to provide a rotational sliding surface for annular magnet 86. A similar piece of insulating material 100 is provided as a cover for a chamber 102 in which annular magnet 84 is housed.

The operation of the embodiment disclosed in FIGS. 1–5 will now be described. Cams 72 will typically be secured to spindle 74 such that set screws 78 are in angular orientations about spindle 74 to open or close selected switches 38 in a predetermined sequence relative to the angular position of shaft 14. It should be noted that switches 38 could be of any snap-acting type having on and off states. Annular magnet 84 rotates in conjunction with the rotation of annular magnet 86 since the magnets are magnetically coupled through non-magnetic wall 80 by an attractive magnetic force. The north and south poles of annular magnets 84 and 86 align with magnetic flux fields locking the magnets into synchronism. Microswitches 38 may provide a number of indication or control functions. For example, in addition to generating a signal corresponding to an open or closed condition of valve member 18, the change of position of valve member 18 may through one of the microswitches 38 control the opening or closing of additional valve members in conduit 20. The timing of the opening or closing of successive valve members in conduit 20 may be critical, and therefore to accurately regulate such valve functions the cam members 72 can be adjusted in their positioning about spindle 74 to advance or delay the actuation of actuating arms 50 by contact with set screws 78.

The magnetic coupling between shaft 14 and spindle 74 also allows for overtorquing with no damage to the position indicator and control. For example, if shaft 14 is overtorqued, the poles of magnet 86 will simply "slip" or override the poles of magnet 84 thereby "skipping" to the next attractive magnetic field. The device can be reset to the proper alignment of magetic fields without disassembly by merely rotating shaft 14 to the appropriate position.

The threaded connection and O-ring seal between housing member 12 and housing member 30 effectively isolates switch cavity 34 from the surrounding environment. Microswitches 38 are therefore not subjected to dust, moisture or other corrosive or explosive contaminants. System failures, due to problems encountered when the microswitches are subjected to such severe environmental conditions are eliminated in the present invention. A threaded connection and O-ring are illustrated in the preferred embodiment, and it is to be understood that alternative means of providing a sealed switch cavity 34 are contemplated within the spirit and scope of the present invention.

Figure 10:
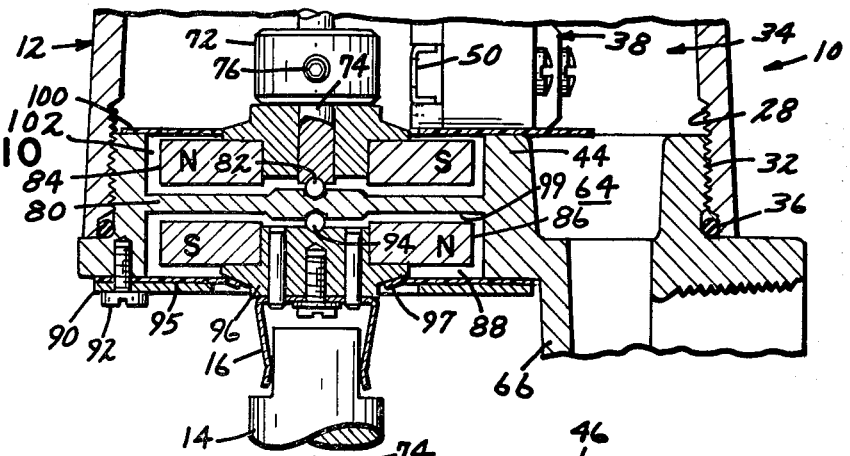
FIG. 10 is a fragmentary sectional view taken from FIG. 3 with portions thereof broken away.
Figure 11:
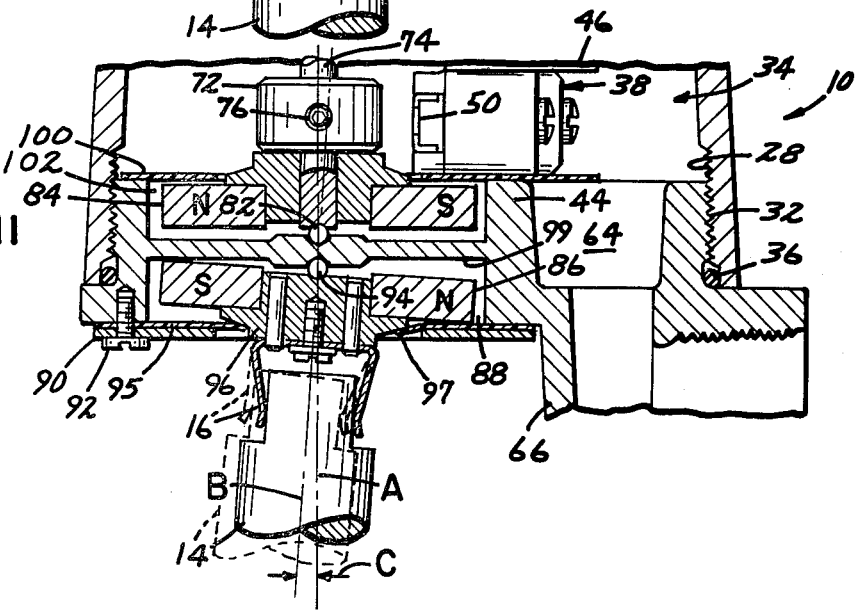
FIG. 11 is a view similar to FIG. 10 and illustrating the misalignment of the rotational axis of the driving magnet of the device.

As shown in FIGS. 3 and 10, spindle 74, magnet 84, and magnet 86 each have rotational axes that are aligned with each other. Ball bearings 77, 82, and 94 provide self-aligning bearing means that allow for some misalignment of the rotational axes. In particular, FIG. 11 illustrates the misalignment of the rotational axis of driving magnet 86 with respect to the rotational axis of driven magnet 84 and cam spindle 74. More specifically, a generally vertical broken line A designates the rotational axis of cam spindle 74 and driven magnet 84. The rotational axis of driving magnet 86 is designated as B and the misalignment angle between axes A and B is designated as C. It is not uncommon for such misalignment to occur during the attachment of the device of the present invention to rotary shaft 14. Such misalignment may be necessitated by virtue of the various structures of rotary shaft actuators 22. However, the self-aligning bearing means of the present invention allows such misalignment without sacrificing performance of the rotary shaft position indicating device 10.

The self-aligning bearing support means provided by ball bearings 77 and 82 provide a production tolerance permitting some misalignment of the axis A with respect to a line perpendicular or normal to wall 80. Again, by virtue of the self-aligning bearing means of the present invention, misalignment of cam spindle 74 would not affect the operating performance of the present invention. By and large, however, it will be more common that some misalignment of the rotational axis B of driving magnet 86 will be necessary. FIG. 11 illustrates a misalignment wherein axis B may be described as being misaligned in a clockwise direction with respect to axis A. It is understood, however, that misalignment wherein axis B may be described as being disposed counterclockwise universally 360° with respect to axis A is also permitted by the present invention. As shown in FIG. 11, magnet support 96 bears against an inner edge portion 97 of annular layer 95 causing inner edge portion 97 to deflect outwardly from chamber 88. Annular layer 95 is preferably a flexible nylatron washer. A second nylatron washer (not shown) may be affixed to wall surface 99 of chamber 88. Although the significant portion of the misalignment will be taken up by means of the self-aligning bearing means, spring clip 16 is somewhat resilient, as has been described, and therefore, will deflect somewhat as illustrated in FIG. 10, to also permit misalignment with respect to shaft 14. The degree of misalignment permitted by the self-aligning bearing means is determined by the size of chamber 88. Preferably, chamber 88 will be sized to allow a maximum amount of misalignment and yet maintain magnetic coupling between driving magnet 86 and driven magnet 84.

Figure 12:
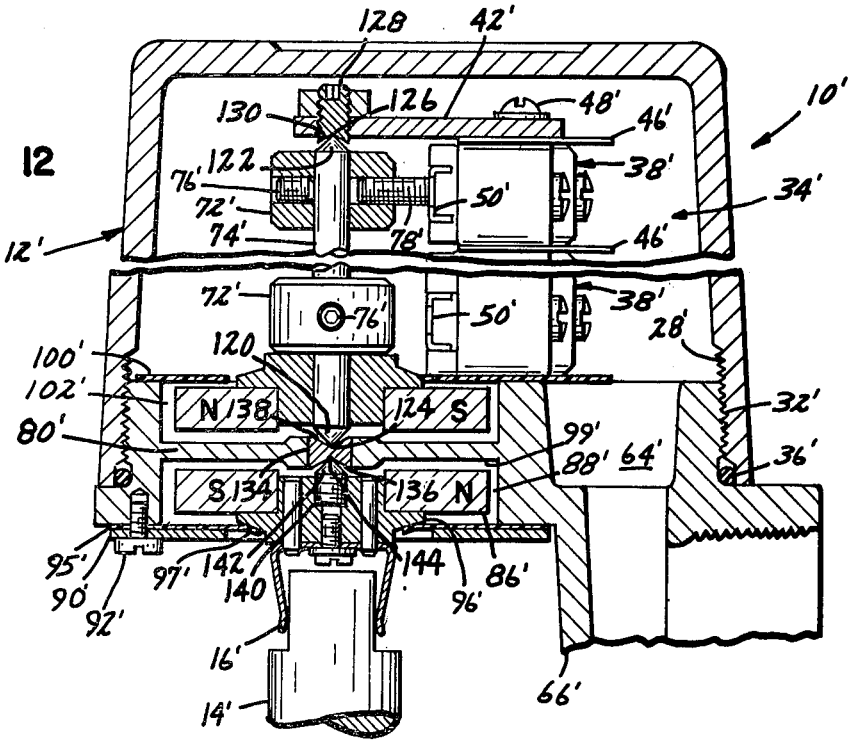
FIG. 12 is a fragmentary sectional view of FIG. 3 with portions thereof broken away and showing an alternative embodiment of the present invention.

FIG. 12 illustrates an alternative embodiment of the self-aligning bearing means in the device of the present invention. In particular, cam spindle 74' is provided with tapered end portions 120 and 122 having terminal pointed ends 124 and 126, respectively. Support plate 42' may be provided with a suitable bearing material member 128 which has a conical recess at 130 engaged by pointed end 126. Wall 80' is also provided with a suitable bearing material member 134 with conical recesses 136 and 138 oppositely exposed therein. Pointed end 124 is received within recess 138. Driving magnet 86' is provided with a rod member 140 disposed axially along the rotational axis of magnet 86'. Rod member 140 has a tapered end portion 142 terminating in a point 144 which is received within conical recess 136. The taper end portions 120, 122, and 142 is typically a 70 degree taper while the taper of the conical recesses are typically 90 degrees. FIG. 12 illustrates the rotational axes of cam spindle 74', magnet 84', and driving magnet 86' in alignment. However, point mounts on cam spindle 74' and rod 140 permit misalignment of the rotational axes as previously described and illustrated with respect to FIG. 11.

While two alternative embodiments of bearing structures are disclosed, it is understood that other self-aligning bearing configurations are also contemplated within the spirit and scope of the present invention. For example, commercial self-aligning bearings may be utilized. Additionally, cam spindle 74 may be provided with spherical end portions received within generally concave recesses as opposed to pointed end portions received within conical recesses. Similarly, rod member 140 could be provided with a somewhat rounded end portion received within a concave recess in wall 80'. Finally, it is also contemplated that ball bearings 82 and 77 could be fixed to the ends of spindle 74 as opposed to being merely captured between spindle 74 and the mounting recesses.

Figure 6:
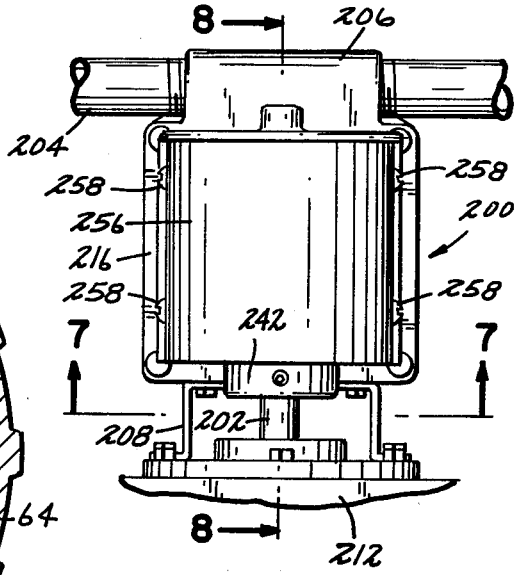
FIG. 6 is a fragmentary side elevation view of the rotary shaft position indicator and control showing an alternate embodiment.
Figure 7:
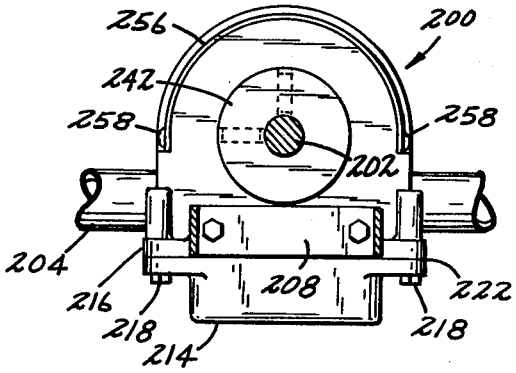
FIG. 7 is a sectional view as seen from the line 7—7 of FIG. 6.

An alternative embodiment of the present invention will be described with reference to FIGS. 6–9. FIG. 6 illustrates a rotary shaft position indicator and control 200 operatively connected to a rotary shaft 202 that may, for example, be connected to a valve member (not shown) as was described with reference to the embodiment illustrated in FIG. 1. An electrical conduit 204 is threadably received within an end portion 206 of rotary shaft position indicator and control 200. The threaded connection of conduit 204 to portion 206 must be sealed or potted to insure a sealed switch cavity. Rotary shaft position indicator and control 200 is mounted by a bracket 208 to a pneumatic rotary shaft actuator 212 which is similar, or identical, to pneumatic actuator 22 shown in FIG. 1.

Figure 8:
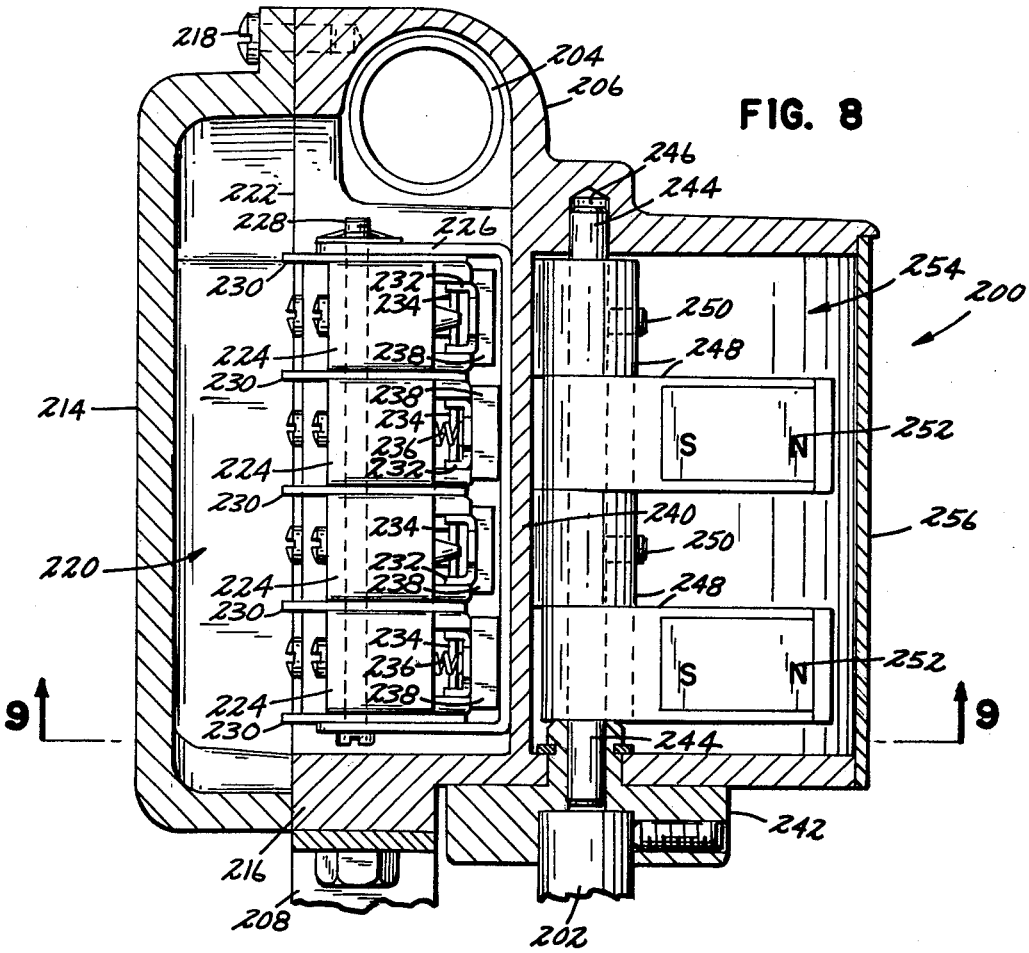
FIG. 8 is an enlarged axial sectional view as seen from the line 8—8 of FIG. 6.
Figure 9:
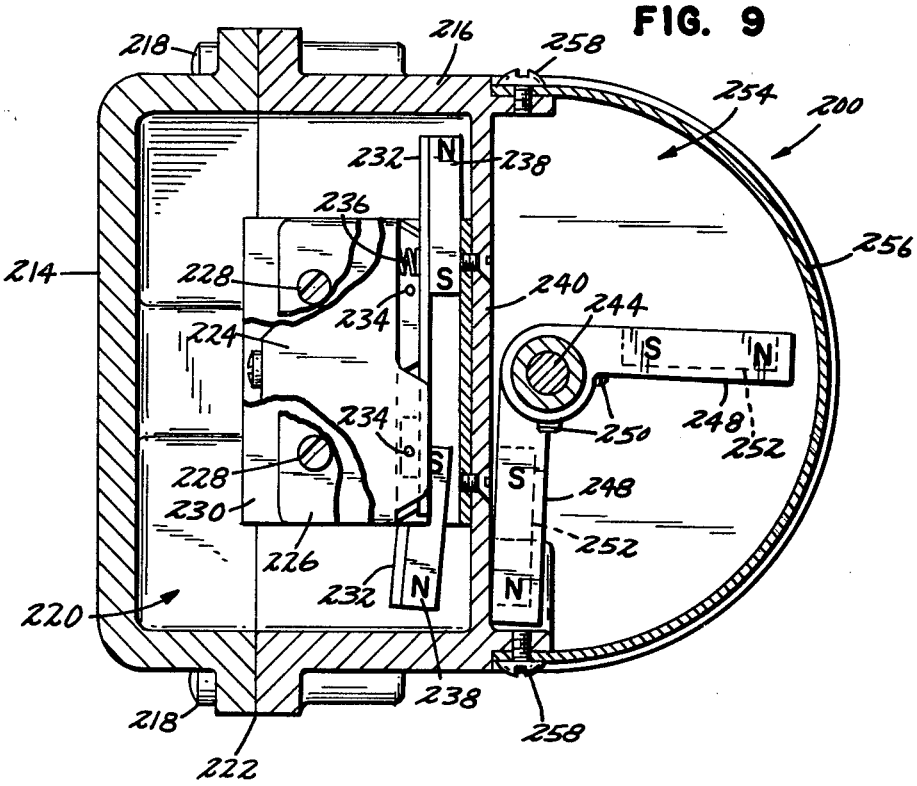
FIG. 9 is a transverse sectional view as seen from the line 9—9 of FIG. 8.

As illustrated more particularly in FIGS. 8 and 9, rotary shaft position indicator and control 200 includes a housing member 214 and a housing member 216 secured together by fasteners 218 to form a microswitch cavity 220. Housing members 214 and 216 have mating surfaces at 222 to which may be applied a suitable sealing material to insure a dust, moisture, and corrosive or explosive foreign material barrier. Disposed within sealed cavity 220 is a plurality of microswitches 224 secured to a bracket 226 by threaded fasteners 228. Insulating spacers 230 are provided between the adjacent microswitches 224. Each microswitch may be provided with a plurality of contacts as described with reference to the first embodiment of the present invention, however, it is to be understood that any switch having a snap-action on-off feature is contemplated within the spirit and scope of the present invention.

Each microswitch has an actuating arm 232 pivoted at 234 and biased by spring 236. Secured to the actuating arm is a bar magnet 238 which establishes a magnetic field generally outward from switch 224 through a non-magnetic wall 240 of housing member 216.

Rotary shaft 202 is secured by means of a coupling member 242 to spindle 244 positioned proximate wall 240. Spindle 244 is received at one end in a recess 246 in housing member 216. A plurality of magnet carriers 248 are adjustably secured to spindle 244 by set screws 250. Disposed within carriers 248 are bar magnets 252 which generate a magnetic flux field in a direction generally outward from the surface of magnet 252. As shown particularly in FIG. 9, when magnets 252 come into close proximity to wall 240 there is an interaction between magnets 252 and magnets 238 resulting in the actuation of microswitches 224. The north and south poles of magnets 238 and 252 are arranged such that magnet 238 is repelled by magnet 252 pivoting switch actuation arm 232 about pivot 234 against the biasing force of spring 236. Magnet carriers 248 and spindle 244 are contained within a chamber 254 enclosed by a cover 256 attached by fasteners 258 to housing member 216. While microswitches having bar magnets secured thereto are disclosed, it is to be understood that any magnetically actuated switches are contemplated within the scope of the present invention.

In operation, as shaft 202 is rotated from one position to another, selected ones of the plurality of magnets 238 will be repelled by magnets 252 actuating the associated microswitches 224. As in the embodiment previously described, microswitches 224 can perform a variety of indication and control functions. To vary the rotary position of shaft 202 at which certain microswitches 224 are actuated, or to advance or delay switch actuation, the angular orientation of selected magnet carriers 248 may simply be adjusted about spindle 244. It will be understood that the maximum permissible rotation of spindle 244 in chamber 254 would be 180 degrees, however, typically the rotation of spindle 244 will be limited to 90 degrees corresponding to open and closed orientations of a valve member associated with shaft 202. Thus, the alternative embodiment also provides the rotary shaft position indicator and control having a sealed microswitch cavity rendering the microswitches unaffected by dust, moisture, or other corrosive or explosive foreign materials.

The present invention, thus, solves the problems associated in the prior art rotary shaft position indicator and controls which have experienced system malfunctions primarily as a result of failures of microswitches subjected to harsh environmental conditions. By providing for actuation of the microswitches in a sealed cavity utilizing magnetic coupling, the switch cavity remains unaffected by such environmental elements. While each of the above embodiments discloses rotary shaft position indicator and controls utilizing electrical switches, it is also contemplated that pneumatic, fluidic or hydraulic switches are within the scope of the present invention.

We claim:

1. A rotary shaft position indicator and control, comprising:

a housing having a first part with a switch cavity and a second part including means for sealing said housing from the exterior surroundings of said housing whereby said switch cavity is protected from dust, moisture, corrosive or explosive foreign materials;

switch means disposed within said switch cavity for providing indication or control signals when actuated;

a rotatable spindle mounted within said cavity and having a first axis of rotation, said spindle further having means for selectively actuating said switch means upon rotation of said spindle;

a first magnet secured to said rotatable spindle adjacent said switch cavity;

a second magnet having a second axis of rotation and being magnetically coupled through a wall of said housing second part to said first magnet whereby upon rotation of said second magnet said spindle is thereby rotated; and means for flexibly coupling the rotary shaft to said second magnet whereby the rotational axis of the rotary shaft may be misaligned with respect to said first rotational axis.

2. A rotary shaft position indicator and control in accordance with claim 1 wherein said first and second magnets are annular magnets having their central axes normally aligned along said first rotational axis of said spindle.

3. A rotary shaft position indicator and control in accordance with claim 2 wherein said switch means further comprises spring-biased switch actuating arms and wherein said means for actuating said switch means further comprises adjustable cams which contact said switch actuating arms.

4. A rotary shaft position indicator and control in accordance with claim 3 wherein said adjustable cams further comprise:

cylindrical members having apertures along their central axes which receive said rotatable spindle;

adjustable set screws received in threaded apertures in said cylindrical members, said set screws extending beyond the outer periphery of said cylindrical members to contact said switch actuating arms.

5. A rotary shaft position indicator and control in accordance with claim 3 further comprising means for varying the position of said cam members circumferentially about said rotatable spindle such that said switches may be actuated at predetermined variable rotational angular positions of said rotary shaft.

6. A rotary shaft position indicator and control in accordance with claim 1 wherein said resilient coupling means further comprises:

a spring clip secured to said second magnet and adapted to receive one end of the rotary shaft.

7. A position indicator and control for a rotary shaft comprising:

a housing having a switch cavity and including means for sealing said housing from the exterior surroundings of said housing whereby said switch cavity is protected from dust, moisture, corrosive or explosive foreign materials;

a switch disposed within said switch cavity, said switch having an actuator member;

a rotatable spindle mounted within said cavity and having a first rotational axis;

a switch actuating member secured to said rotatable spindle and positioned to selectively actuate said switch actuator member;

a first magnet secured to said rotatable spindle and disposed proximate a wall of said housing;

a second magnet magnetically coupled through said wall of said housing to said first magnet, said second magnet having a second rotational axis normally aligned with said first rotational axis;

means for mounting said second magnet to said housing, said mounting means comprising bearing means for permitting angular misalignment of said first and said second rotational axes, and means for retaining said second magnet proximate said housing wall with said bearing means captured between said wall and said second magnet to permit rotation of said second magnet; and means for flexibly coupling said second magnet to the rotary shaft whereby allowance is made for misalignment of the rotational axis of the shaft with said second rotational axis.

8. A position indicator and control in accordance with claim 7 wherein said wall of said housing has a recess therein, and wherein said bearing means comprises a ball bearing, said second magnet having a recess therein disposed along said second rotational axis, said ball bearing captured between said recesses in said housing and said magnet.

9. A position indicator and control in accordance with claim 8 wherein said means for mounting said second magnet to said housing further comprises a flexible washer member secured to said housing and engaging said second magnet to urge said second magnet towards said housing wall.

10. A position indicator and control in accordance with claim 8 further comprising:

a plurality of switches disposed within said switch cavity; and a plurality of switch actuating members secured along said rotatably spindle, each of said switch actuating members positioned to selectively actuate one of said switches.

11. A position indicator and control in accordance with claim 7 wherein said rotatable spindle is normally mounted with said first rotational axis perpendicular to said wall of said housing and comprising bearing means for permitting said first rotational axis to be disposed at a misalignment angle with respect to said normal alignment.

12. A position indicator and control in accordance with claim 7 wherein said wall of said housing has a recess therein and wherein said bearing means comprises a rod member affixed to said second magnet and disposed along said second rotational axis, said rod member having a tapered end portion terminating in a contact point received in engagement with said wall within said recess.

* * * * *